United States Patent [19]

Granado

[11] Patent Number: 4,968,026

[45] Date of Patent: Nov. 6, 1990

[54] EXERCISE APPARATUS

[76] Inventor: William C. Granado, 5585 Springhouse Dr. #27, Pleasanton, Calif. 94566

[21] Appl. No.: 459,249

[22] Filed: Dec. 29, 1989

[51] Int. Cl.[5] ..... A63B 21/062

[52] U.S. Cl. ..... 272/118; 272/93

[58] Field of Search ..... 272/93, 116, 117, 118, 272/123, 124, 134, 900

[56] References Cited

U.S. PATENT DOCUMENTS

| | | | |
|---|---|---|---|
| 4,431,181 | 2/1984 | Baswell | 272/118 X |
| 4,657,246 | 4/1987 | Salyer | 272/118 X |
| 4,700,944 | 10/1987 | Sterba et al. | 272/117 |
| 4,712,793 | 12/1987 | Harwick et al. | 272/118 |
| 4,781,374 | 11/1988 | Lederman | 272/134 |
| 4,809,972 | 3/1989 | Rasmussen et al. | 272/118 |
| 4,907,798 | 3/1990 | Burchatz | 272/123 X |

FOREIGN PATENT DOCUMENTS

| | | | |
|---|---|---|---|
| 3427769 | 1/1986 | Fed. Rep. of Germany | 272/118 |
| 2264569 | 11/1975 | France | 272/117 |

*Primary Examiner*—Robert Bahr

*Attorney, Agent, or Firm*—Leon Gilden

[57] ABSTRACT

An exercise apparatus, particularly arranged for use by children, includes spaced parallel planar sides orthogonally mounted to a bottom floor panel, with a top panel orthogonally and integrally securing the planar sides together. The planar sides include a series of spaced parallel bars, wherein a bottom bar is positioned for redirecting a flexible line secured to a weighted resistant plate overlying a pulley for accepting tension against the line for use by an individual. The medial bar positions an associated handle mounted to a forward end of the line with a top bar mounted for grasping by an individual for use in an exercise environment. A first support cylinder telescopingly and adjustably receives a plurality of game members therewithin, wherein additionally an "L" shaped support post directed through the top panel and floor selectively receives one of a plurality of tethered supporting devices.

6 Claims, 4 Drawing Sheets

EXERCISE APPARATUS

BACKGROUND OF THE INVENTION

1. Field of the Invention

The field of invention relates to exercise equipment, and more particularly pertains to a new and improved exercise apparatus particularly arranged for use by children and individuals of lesser physical stature.

2. Description of the Prior Art

Exercise apparatus for use by individuals in a variety of applications is known in the prior art. The prior devices has typically required the use of a myriad of equipment to accommodate various sporting activities. Examples of the prior art include U.S. Pat. No. 4,712,793 to Harwick wherein a framework mounts a reciprocatable weight lifting plate set with a tension line mounted thereto, with the tension line wound through a series of pulleys to enable lifting of the weight set upon a like movement of the line.

U.S. Pat. No. 4,729,461 to Desjardins sets forth a weight lifting station including a multi-station configurational framework with a plurality of rectilinear cages connected in abutting back-to-back relationship, with a horizontal bench press and an angularly oriented bench press adjustably mounted to each of the respective rectilinear cages.

U.S. Pat. No. 4,753,437 to Lapceivic provides a weight lifting apparatus with a rectilinear cage mounting a bar therewithin, with an "L" shaped framework mounted to the rectilinear framework for reciprocating the bar, with weighted stations securable relative to the bar for providing resistance during a weight lifting event.

U.S. Pat. No. 4,648,594 to Schleffendorf wherein a stack of weights includes a plurality of pulleys at its upper end with the pulleys cooperative with further pulleys, wherein two resistance devices are utilized, with the first device causing a varying movement of the second device, and the second device dampening movement of the first device, whereby different resistance curves can be obtained by changing the initial resistance of the second device thereby changing the degree of interconnection within a first and second resistance device.

U.S. Pat. No. 4,720,100 to DuBuy wherein an apparatus for exercising of arm muscles of an individual includes a plurality of pivotal shafts mounted adjacent a support plate positioned between the shafts, wherein the shafts are mounted on a base and rotatable about their longitudinal axis, wherin hand grips are provided to enable torquing of the shafts about their axes.

As such, it may be appreciated that there is a continuing need for a new and improved exercising apparatus which addresses both the problems of ease of use and particular application to children and the like enabling a variety of sporting events to be accommodating by the apparatus.

SUMMARY OF THE INVENTION

In view of the foregoing disadvantages inherent in the known types of exercise apparatus now present in the prior art, the present invention provides an exercise apparatus wherein the same includes a plurality of stations accommodating a variety of sporting events. As such, the general purpose of the present invention, which will be described subsequently in greater detail, is to provide a new and improved exercise apparatus which has all the advantages of the prior art exercise apparatus and none of the disadvantages.

To attain this, the present invention includes an apparatus, particularly arranged for use by children, including spaced parallel planar sides orthogonally mounted to a bottom floor panel, with a top panel orthogonally and integrally securing the planar sides together. The planar sides include a series of spaced parallel bars, wherein a bottom bar is positioned for redirecting a flexible line secured to a weighted resistant plate overlying a pulley for accepting tension against the line for use by an individual. The medial bar positions an associated handle mounted to a forward end of the line with a top bar mounted for grasping by an individual for use in an exercise environment. A first support cylinder telescopingly and adjustably receives a plurality of game members therewithin, wherein additionally an "L" shaped support post directed through the top panel and floor selectively receives one of a plurality of tethered supporting devices.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

Still another object of the present invention is to provide a new and improved exercise apparatus wherein the same is provided with a plurality of stations wherein the stations accommodate a plurality of sporting events to be utilized by individuals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
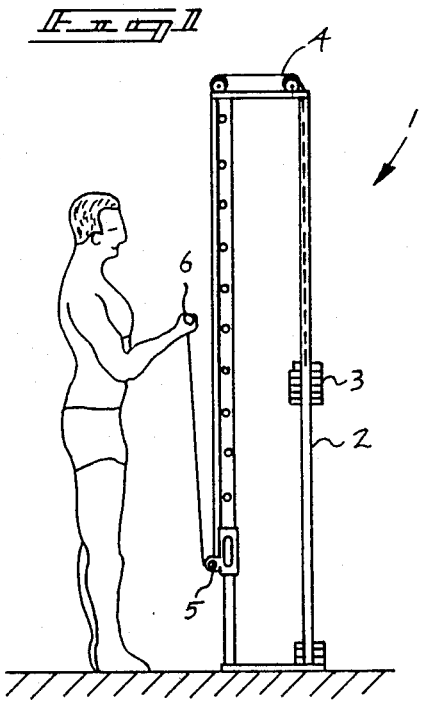
FIG. 1 is an orthographic view taken in elevation of a prior art exercise apparatus.

With reference now to the drawings, and in particular to FIGS. 1 to 8 thereof, a new and improved exercise apparatus embodying the principles and concepts of the present invention and generally designated by the reference numeral 10 will be described.

FIG. 1 is illustrative of a typical prior art device 1 comprising a rectilinear frame 2 slidingly receiving a stack of weights 3 within a rear portion of the frame, wherein the weights 3 include a flexible line 4 cooperating with a series of pulleys, and a forward pulley 5 wherein a handle 6 secured to the line at a forward end thereof enables an individual to reciprocate the stack of weights 3 during a weight lifting event.

Figure 2:
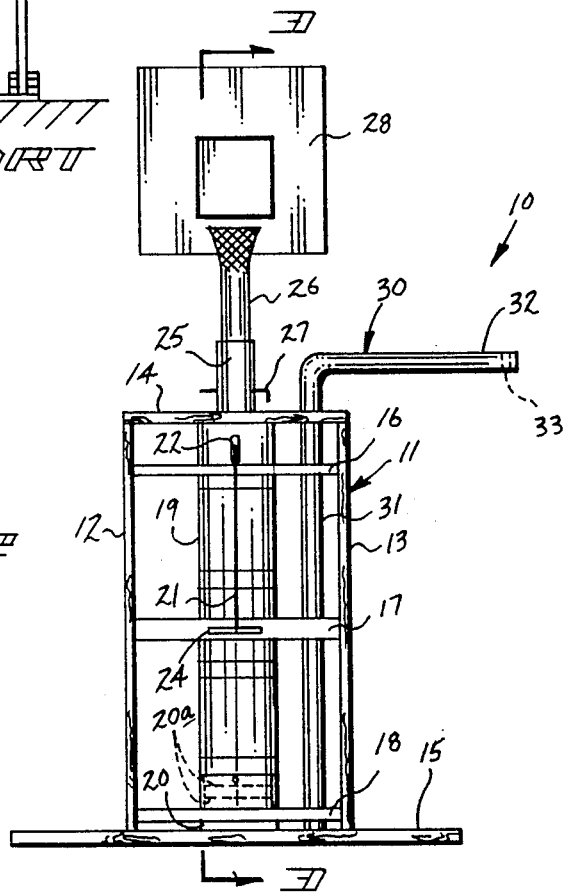
PRIOR ART Fig 2
FIG. 2 is an orthographic frontal view taken in elevation of the instant invention.

The exercise apparatus of the instant invention, as illustrated in FIG. 2, essentially comprises a support framework 11 that includes a vertical first side member 12 spaced from and parallel to a second side member 13 defined as planar panels, with a top plate 14 orthogonally securing top edges of the side members 11 and 12 together, with a floor 15 integrally mounted to and extending exteriorly beyond the bottom edges of the side members 12 and 13. A series of rods including a top rod 16, a central rod 17, and a bottom rod 18 are orthogonally directed and secured adjacent forward vertical edges of the side members 12 and 13, wherein the rods are parallel relative to one another. A medially positioned weight guide tube 19 is orthogonally and integrally mounted between the top plate 14 and the floor 15 to reciprocatingly guide a plate member 20 with a flexible line 21 mounted thereto, wherein the flexible line 21 is directed over a pulley 22 mounted diagonally adjacent an upper end of the guide tube 19 and directed downwardly therefrom to overlie the central rod 17 to orient the associated handle 24 mounted to the forward free end of the flexible line 21 in an easily graspable orientation. The top rod 16 may be used as a grasp bar for an individual to provide a basis for a "chin-bar", and wherin the bottom rod 18 allows the line 21 to be directed thereunder, wherein the pull of the line 21 by an individual is effected in a reverse orientation to that provided by the pulley 22. It should also be noted that additional weights or plates **20*a* may be mounted to overlie the plate member 20** to vary the resistance weight total during an exercise procedure of event.

Figure 3:
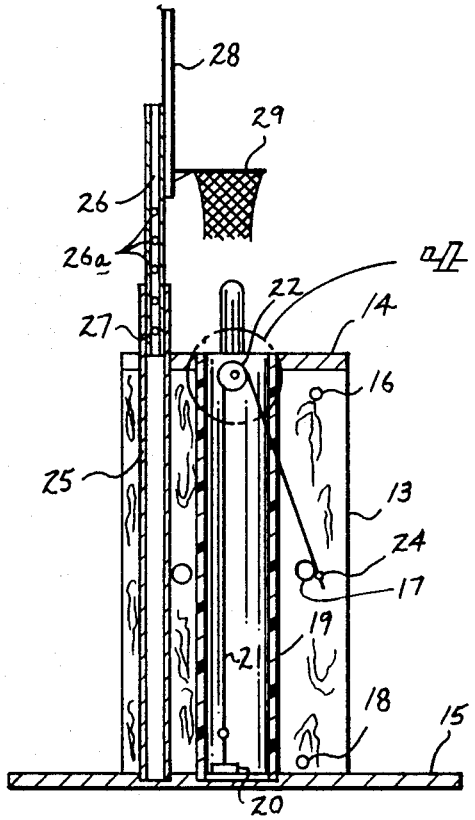
FIG. 3 is an orghographic view taken along the lines 3—3 of FIG. 2 in the direction indicated by the arrows.
Figure 4:
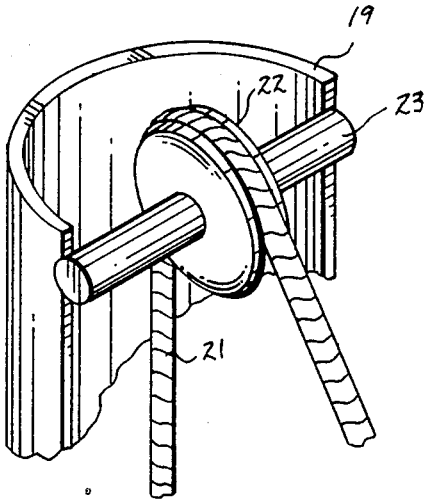
FIG. 4 is an isometric illustration of section 4, as illustrated in FIG. 3.
Figure 5:
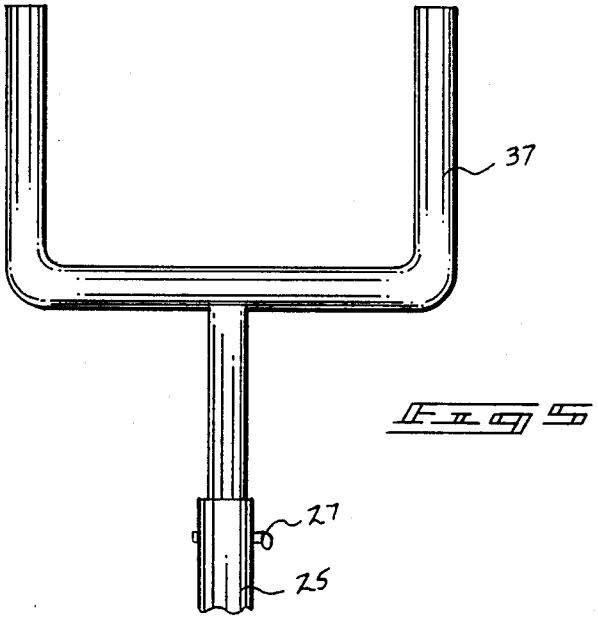
FIG. 5 is an orthographic view taken in elevation of the support post receiving a goal post apparatus therewithin.
Figure 6:
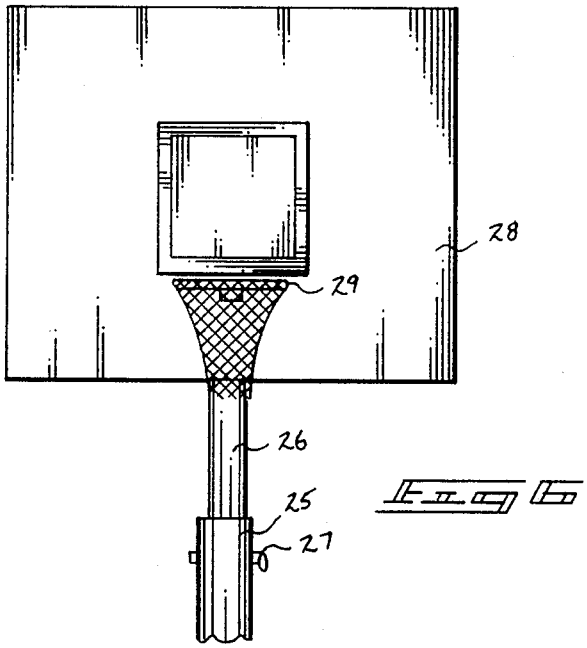
FIG. 6 is an orthographic illustrating of the support post receiving a basketball station therewithin.

Reference to FIG. 3 illustrates a support cylinder 25 fixedly and orthogonally mounted and secured to the floor 15 at a lowermost end of the support cylinder 25 and directed upwardly and extending through the top plate 14. The support cylinder 25 telescopingly receives a further support cylinder 26, wherein the further support cylinder 26 is formed with a series of aligned diametrically directed adjustment apertures **26*a* to receive a lock pin 27 through the support cylinder 25 and through one of the aligned apertures 26*a* to secure the support cylinder 26 in a predetermined orientation relative to the support cylinder 25. The further support cylinder 26 includes a planar backboard 28, mounted thereon with a basketball hoop 29 orthogonally directed outwardly from a lower forward portion of the backboard 28. Substitute further support cylinders are provided wherein reference to FIG. 5 illustrates the use of a "U" shaped goal post 37 receivable through the support cylinder 25, wherein the "U" shaped goal post 37 is formed with a vertical stanchion receivable and positionable within the support cylinder 25**.

Figure 7:
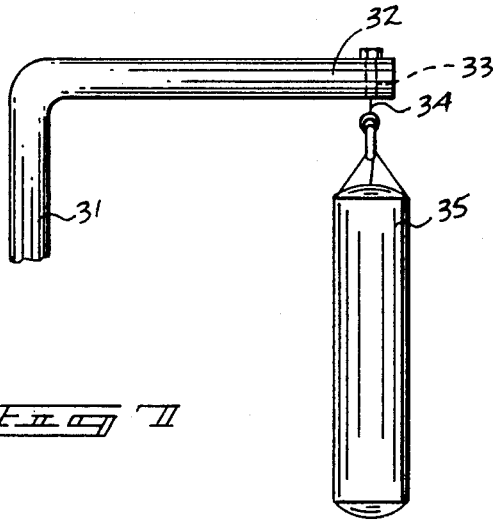
FIG. 7 is an orthographic sectional view of the "L" shaped rod member receiving a boxing apparatus thereon.
Figure 8:
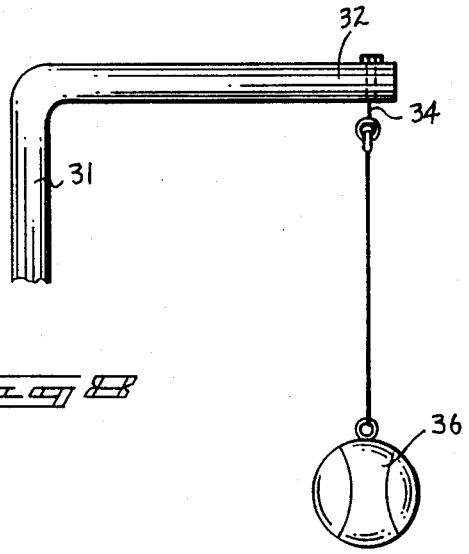
FIG. 8 is an orthographic sectional view of the "L" shaped support member receiving a tether ball secured thereon.

An "L" shaped rod member 30 is mounted adjacent the guide tube 19 and directed orthogonally through the top plate 14 and mounted to the floor 15 at a bottom end of the "L" shaped rod member 30. The "L" shaped rod member 30 comprises a first leg 31 vertically oriented and directed from the floor 15 through the top plate 14, with a second leg 32 directed orthogonally relative to the first leg 31 and wherin a remote terminal end of the second leg 32 is positioned exteriorly of the first and second side mebmers 12 or 13. A leg aperture 33 is formed adjacent the terminal end of the second leg 32 to receive a support line and ring 34 therethrough. Reference to FIGS. 7 and 8 illustrate the use of a boxing bag 35 and selectively, a tether ball 36 mounted to the support liner ring 34 in a selective manner. Accordingly, it is understood that a plurality of sporting events and practice therefore is provided by the various stations throughout the exercise apparatus 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An exercise apparatus comprising, in combination, a framework including a first side member defined by a finite length spaced from and parallel to a second side member defined by the finite length, and a top panel overlying and fixedly mounted to respective top ends of the first and second side members, and a floor panel orthogonally and fixedly mounted to respective bottom ends of the first and second side members, wherein the floor panel surroundingly extends beyond the respective bottom edges of the first and second side panels providing stability to the framework, and a guide member orthogonally mounted at its upper end to the top panel and orthogonally mounted at its lower end to the floor, and a pulley mounted adjacent to the upper end of the guide member, and a flexible line guidingly mounted around the pulley including a handle member at a forward terminal end of the flexible line and a weighted plate member secured to a rear terminal end of the flexible line, the weighted plate member aligned with and guided within the guide member, wherein the guide member positions the weighted member for vertical movement, and a first support means directed through the top panel and fixedly mounted at its lower end to the floor panel for receiving one of a plurality of further supports therewithin, a second support means fixedly mounted at its lower end to the floor panel adjacent the guide member and extending above the top panel, wherein the second support means includes a first leg secured to the floor and the top panel, and a second leg orthogonally mounted to the first leg and extending beyond the first and second side members, and the second support means including a mounting means for securement of a plurality of sporting equipment members thereto.

2. An apparatus as set forth in claim 1 wherein the guide means inlcudes a guide tube, the guide tube having a diameter sufficient to encompass the weighted plate member therewithin.

3. An apparatus as set forth in claim 2 wherein the first side members includes a first panel, and the second side member includes a second panel, the first panel and the second panel encompassing the guide tube, and at least part of the first support means and the second support means therewithin.

4. An apparatus as set forth in claim 3 including a top rod, a central rod, and a bottom rod, the top, central, and bottom rods aligned parallel relative to one another and positioned adjacent forward edges of the first and second side panels, the bottom rod permitting orienting of the flexible line therearound, the central rod maintaining the handle member in an accessible orientation relative to the first and second side panels, and the top rod providing a grasping bar for an individual for effecting an exercising event.

5. An apparatus as set forth in claim 4 further comprising a plurality of further supports and wherein the first support means includes a support cylinder, the further supports include a first and second further support cylinder, the first and second further support cylinders each including a series of aligned apertures therethrough cooperative with a pin directed through the support cylinder to adjustably mount the first and second further support cylinders relative to the support cylinder, and the first further support cylinder including a basketball apparatus mounted thereto, and the second further support cylinder including a "U" shaped goal post mounted thereto for selective use by an individual.

6. An apparatus as set forth in claim 5 further comprising a plurality of sporting equipment members and wherein the sporting equipment members inlcude a tether ball selectively mounted to the mounting means, and an elongate longitudinally aligned boxing bag selectively securable to the mounting means, the mounting means includes a support line mounted to the second leg and a ring mounted to a lowermost end of the support line fixedly secured with the tether ball and boxing bag thereto.

* * * * *